US009015973B2

(12) United States Patent
Pasternak et al.

(10) Patent No.: US 9,015,973 B2
(45) Date of Patent: Apr. 28, 2015

(54) DISPLAY CARD HOLDER ASSEMBLY

(71) Applicant: PH2 Engineered Products, LLC, Mequon, WI (US)

(72) Inventors: M. Randall Pasternak, Thiensville, WI (US); George Hinkens, Mequon, WI (US)

(73) Assignee: PH2 Engineered Products, LLC, Mequon, WI (US)

( * ) Notice: Subject to any disclaimer, the term of this patent is extended or adjusted under 35 U.S.C. 154(b) by 0 days.

(21) Appl. No.: 14/031,624

(22) Filed: Sep. 19, 2013

(65) Prior Publication Data

US 2015/0075041 A1 Mar. 19, 2015

(51) Int. Cl.

| | |
|---|---|
| ***G09F 3/20*** | (2006.01) |
| ***A63B 69/36*** | (2006.01) |
| ***G09F 1/10*** | (2006.01) |

(52) U.S. Cl.

CPC . *G09F 3/20* (2013.01); *A63B 69/36* (2013.01); *A63B 2069/3602* (2013.01); *G09F 1/103* (2013.01)

(58) Field of Classification Search

CPC ..... G09F 1/03
USPC ..... 40/373, 649, 650, 652, 654.01, 661, 40/661.08

See application file for complete search history.

(56) References Cited

U.S. PATENT DOCUMENTS

| | | | | |
|---|---|---|---|---|
| 3,025,093 | A | 3/1962 | Millman | |
| 3,514,820 | A | 6/1970 | Rogg | |
| 3,665,629 | A | 5/1972 | Shore | |
| 3,909,888 | A | 10/1975 | Funston et al. | |
| 3,958,788 | A * | 5/1976 | Feibelman | 248/214 |
| 4,089,116 | A * | 5/1978 | Bearinger | 33/485 |
| 4,449,310 | A | 5/1984 | Kline | |
| 4,498,827 | A | 2/1985 | Mair | |
| 4,645,105 | A | 2/1987 | Plumbridge | |
| 4,699,303 | A | 10/1987 | Kline | |
| D295,919 | S | 5/1988 | Makio | |
| 5,020,196 | A | 6/1991 | Panach et al. | |
| 5,022,689 | A | 6/1991 | Perdue et al. | |
| 5,134,757 | A | 8/1992 | Johnson | |
| 5,184,375 | A | 2/1993 | Hoyt | |
| 5,489,121 | A | 2/1996 | Mohr | |
| 5,676,400 | A | 10/1997 | Lin | |
| 5,697,176 | A | 12/1997 | Kuni | |
| 5,996,264 | A * | 12/1999 | Nagel | 40/649 |
| 6,003,259 | A * | 12/1999 | Krapf et al. | 40/658 |
| 6,336,765 | B1 | 1/2002 | Watanabe | |
| 6,357,090 | B1 | 3/2002 | Murai | |
| 6,484,429 | B1 | 11/2002 | Przylucki | |
| 6,658,777 | B2 | 12/2003 | Dundorf | |
| 6,678,977 | B1 * | 1/2004 | Sherman | 40/341 |

(Continued)

FOREIGN PATENT DOCUMENTS

| | | |
|---|---|---|
| JP | 2000356948 | 12/2000 |
| WO | WO89/10605 | 11/1989 |

*Primary Examiner* — Gary Hoge

(74) *Attorney, Agent, or Firm* — Ryan Kromholz & Manion, S.C.

(57) ABSTRACT

A display card holder for use on support surfaces, such as golf carts includes a display card retaining sleeve and a sleeve holder. The sleeve holder includes an entrance slot having inwardly extending retention ridges which deform and thereby reduce vibration of the retaining sleeve. The sleeve holder may further include a mechanical locking mechanism for securing the sleeve in the sleeve holder.

11 Claims, 11 Drawing Sheets

(56) References Cited

U.S. PATENT DOCUMENTS

| | | | | |
|---|---|---|---|---|
| 6,688,027 | B2 | 2/2004 | Fink | |
| 7,103,997 | B2 * | 9/2006 | Ruffino | 40/658 |
| 7,121,030 | B2 * | 10/2006 | Schneider | 40/661 |
| 7,159,347 | B1 * | 1/2007 | Ngan | 40/514 |
| 7,207,129 | B2 | 4/2007 | Buchanan et al. | |
| D554,561 | S | 11/2007 | DiCarlo | |
| 7,293,382 | B2 | 11/2007 | Polvere et al. | |
| 7,487,611 | B2 * | 2/2009 | Robb | 40/658 |
| 7,743,541 | B2 * | 6/2010 | Suciu et al. | 40/658 |
| 7,823,311 | B2 * | 11/2010 | Pitcher et al. | 40/790 |
| 2002/0035798 | A1 | 3/2002 | Gray | |
| 2004/0128895 | A1 * | 7/2004 | Trudel | 40/761 |
| 2004/0154204 | A1 | 8/2004 | Fu | |
| 2007/0144048 | A1 | 6/2007 | Kodde et al. | |
| 2012/0211534 | A1 | 8/2012 | Hake | |

* cited by examiner

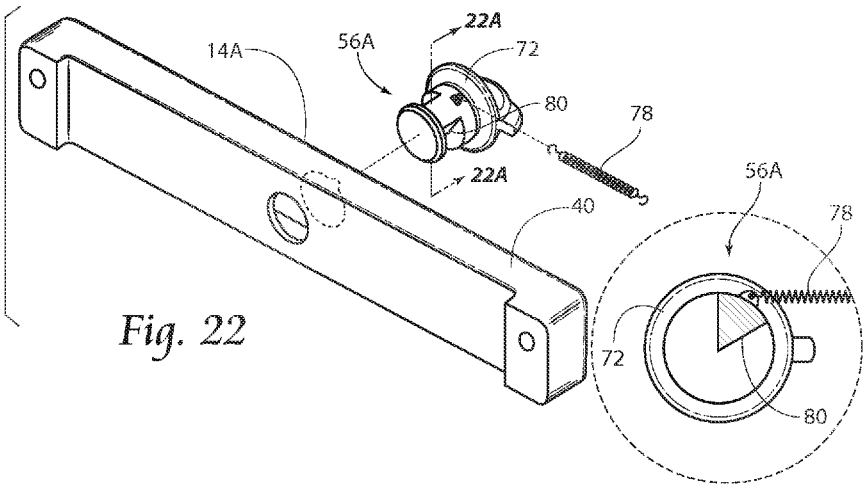
Fig. 22
Fig. 22A
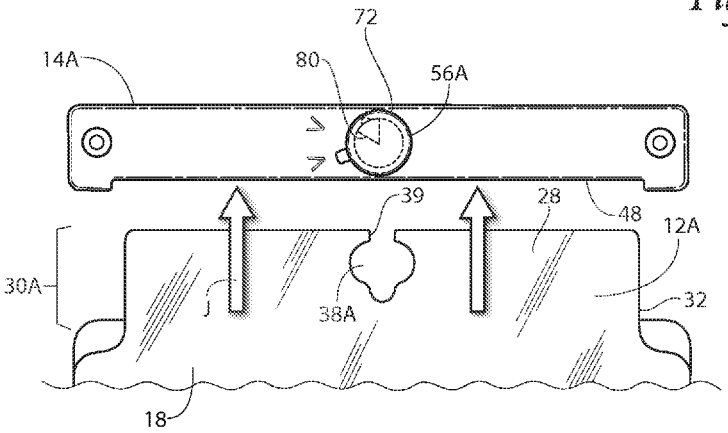
Fig. 23
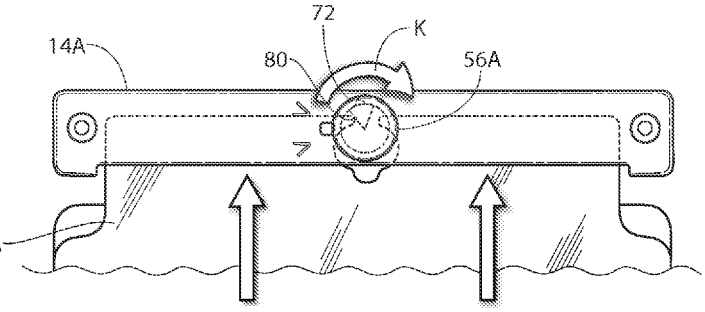
Fig. 24

DISPLAY CARD HOLDER ASSEMBLY

BACKGROUND OF THE INVENTION

The present invention relates to a device for removably holding a disposable card, such as an information card or score card. Cards such as those contemplated for use with the present invention are commonly used in numerous settings, such as during sporting events during which it is desirable to enable a user to easily mark the card, while also enabling handy storage thereof. For example in the game of golf, carts may be readily identified by information cards attached thereto. Cards may also be used by players to record individual scores along with those of playing companions. In golf, cards such as these also include information about the course being played, such as layout, distances and par. Cards such as these should be readily accessible and removable, for verbiage altering, modification, or replacement while also being protected from the elements, yet adequately secured.

The device of the present invention may also be used in other applications. For example, the device may used in a store or other point of purchase location to hold a card having indicia of the products or services being offered for sale. As another non-limiting example, the device may be used on a machine and include job or safety specifications. Due to the nature of the invention, the device may also find application in a setting where a first set of information is printed on one side of the card and a second set of information is printed on the opposite side of the card. The desired information may be displayed depending upon the orientation of the selected card side relative to the invention.

SUMMARY OF THE INVENTION

The present invention relates to an information card holder assembly, in particular, a golf cart information card holder, although it is to be understood that the invention may be used in any environment in which an information card is desired to be temporarily but securely affixed to a supporting structure. The holder assembly of the present invention preferably includes two main components: a card retaining sleeve and a sleeve holder. The sleeve holder is preferably adapted to be affixed to a selected support structure and also to removably hold the card retaining sleeve. As such, the sleeve holder preferably includes an open slot having means for griping, such as retention ridges, configured to deform the sleeve and to thereby use the forces created in deformation to hold the sleeve in the sleeve holder slot and to minimize its vibration therein, as when for example, the assembly is attached to a moving object such as a golf cart. Alternatively, the sleeve holder may include a plurality of compression springs in the place of retention ridges. The compression springs press the card retaining sleeve into the sleeve holder and function, as do the retention ridges, to minimize vibration and rattling. The sleeve holder may further include other mechanical gripping means such as a compression button to provide added attaching means to the sleeve holder. As mentioned, the sleeve holder may be further designed for attachment to an underlying support surface, such as a golf cart for the convenience of the user.

The card retaining sleeve includes a front panel and a back panel, at least one closed edge, and at least one open edge. The card retaining sleeve is adapted to receive an information card member therein. The retaining sleeve is further configured with a top edge having an extending portion including a cutout portion. The extending portion is shaped for deformation and retention in the sleeve holder slot, with the cutout portion having a shape configured for facile retention and release by a push button, lever or other retention mechanism, as will be discussed. The side edges may be further provided with cutout portions for facile fingertip removal of a card.

BRIEF DESCRIPTION OF THE DRAWINGS

FIG. 22 is an exploded view of an alternative sleeve holder.

FIG. 22A is a cross-sectional view taken along line 22A-22A in FIG. 22.

FIGS. 23-25 are fragmentary sectional views illustrating a card retaining sleeve being positioned into the sleeve holder illustrated in FIG. 22.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
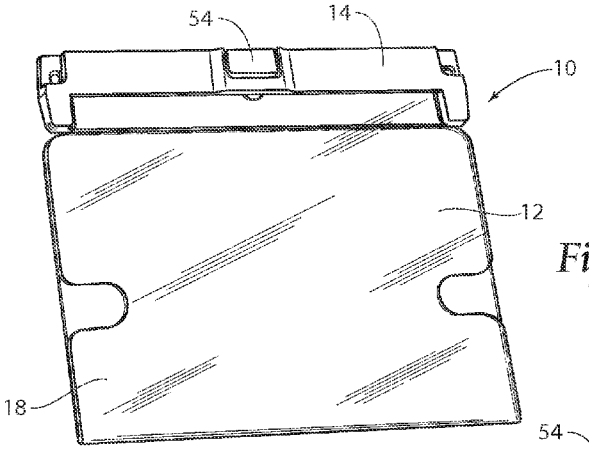
FIG. 1 is a perspective view of a card retaining system according to the present invention.
Figure 2:
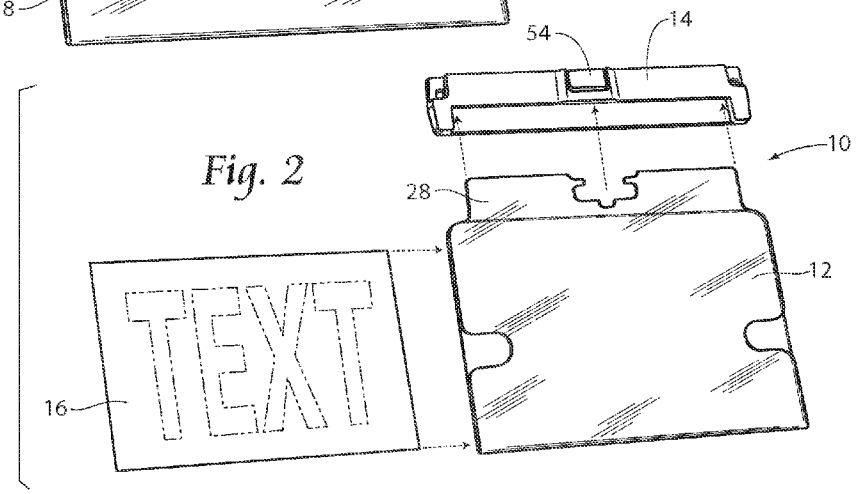
FIG. 2 is an exploded view of the system illustrated in FIG. 1 and showing a card used in conjunction therewith.
Figure 3:
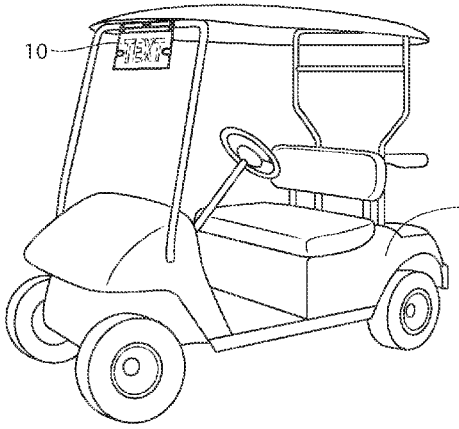
FIG. 3 is a view illustrating the system shown in FIGS. 1 and 2 in use.
Figure 4:
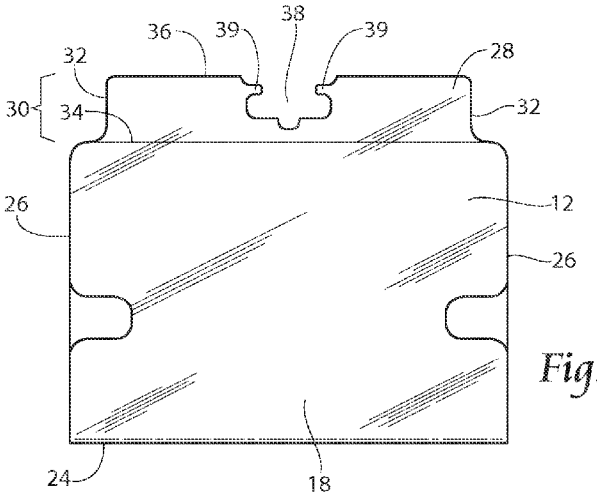
FIG. 4 is a front view of a card retaining sleeve for use in the present system.
Figure 4A:
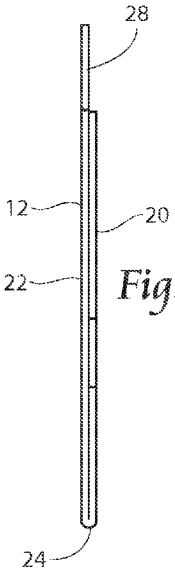
FIG. 4A is a side view of the sleeve illustrated in FIG. 4.

The present invention is directed to a novel card holding system 10 having a card retaining sleeve 12 and a sleeve holder 14. With attention to FIGS. 1 and 2, the system 10 may be seen in conjunction with a card 16 of the type to be retained by the system 10. The system 10 may be temporarily but securely affixed to a supporting structure, such as, by non-limiting example, the golf cart 11 seen in FIG. 3. As may be seen in the views of FIGS. 4 and 4A, the card retaining sleeve 12 preferably includes a sleeve body 18 having a front panel 20, a back panel 22, and at least one closed edge 24. The retaining sleeve 12 further includes two opposed side edges 26, at least one side edge 26 being open to permit a card member 16 (see FIG. 2) passage into the sleeve body 18. The retaining sleeve 12 further includes a top portion 28, oppositely disposed from the closed edge 24. As shown, the top portion 28 extends laterally from the sleeve body 18 to form a preferred top marginal edge profile 30. The profile 30 is adapted for engagement in the sleeve holder 14. A preferred top marginal edge profile 30 includes two opposed side marginal edge portions 32 extending laterally from the sleeve body 18 and a bottom edge portion 34 attached to the sleeve body 18. A top marginal edge portion 36 intersects with the opposed side marginal edges 32 and further includes a cut out edge portion 38 which extends inwardly relative to the side marginal edges 32. The cut out edge portion 38 is further shaped with tabs 39 for engagement with the sleeve holder 14, as will be discussed.

Figure 5:
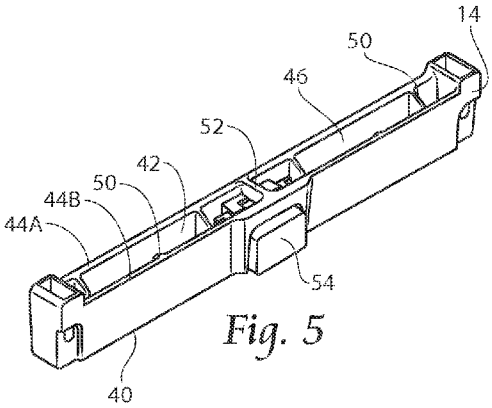
FIG. 5 is a bottom perspective view of a sleeve holder for use in the present system.
Figure 6:
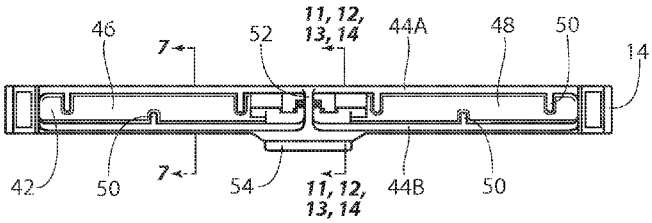
FIG. 6 is a bottom view of the sleeve holder shown in FIG. 5.
Figure 7:
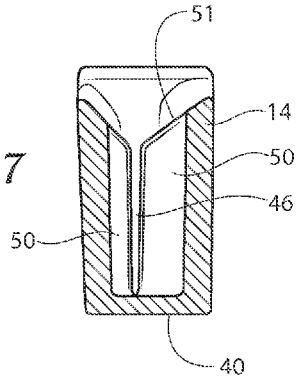
FIG. 7 is a cross sectional view of the sleeve holder shown in FIG. 6 and taken along lines 7-7 thereof.

With reference now to FIGS. 5 and 6, a sleeve holder 14 for use with the present system 10 may be seen. The sleeve holder 14 preferably includes a top 40, a bottom 42, and two side walls 44A, 44B forming a cavity 46 therebetween. The cavity 46 includes an entrance slot 48 for receiving a retaining sleeve 12 into the sleeve holder 14. The entrance slot 48 is adapted to receive the top portion 28 of the card retaining sleeve 12. As illustrated particularly in the view of FIG. 6, the cavity 46 includes side walls 44A, 44B having retention ridges 50. The retention ridges 50 extend laterally inwardly from the side walls 44A, 44B and into the cavity 46. With a view to FIG. 6, it may be seen that the ridges 50 on sidewall 44A and the ridges 50 on sidewall 44B do not line up with one another, but rather, are preferably staggered or off set from one another to produce the desired effect. FIG. 7 illustrates the ridges 50 and shows a ramped leading edge 51. The ramped leading edges 51 of the ridges encourage facile insertion of the retaining sleeve 12 during use. As seen in FIGS. 5 and 6, the sleeve holder 14 may be further provided with a rigid brace member 52 and mechanical sleeve retention, such as the spring biased button mechanism 54 shown.

Figure 8:
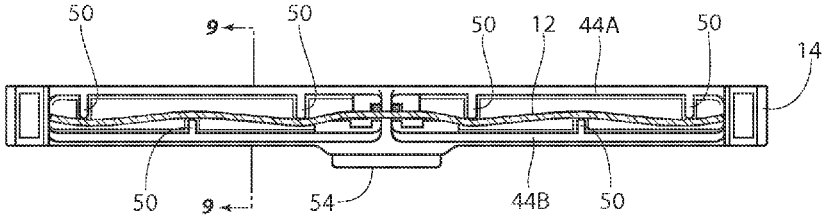
FIG. 8 is a view similar to that of FIG. 6, but showing the card retaining sleeve in retained condition.
Figure 9:
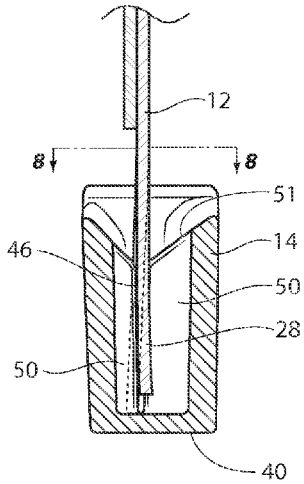
FIG. 9 is a cross sectional view of the system illustrated in FIG. 8 and taken along lines 9-9 thereof.

The views of FIGS. 8 and 9 illustrate the sleeve holder 14 with the sleeve 12 in use position. As shown, the retention ridges 50 contact the top portion 28 of sleeve member 12 to thereby deform the top portion 28. Deformation of the top portion 28 at each retention ridge 50 reduce sleeve 12 rattle and vibration within the sleeve holder 14 when the card holding system 10 is affixed to a moving object, such as a golf cart 11 (see FIG. 3). The view of FIG. 9 specifically illustrates this deformation. The deformation of the top portion 28 creates force between the top portion 28 and the sleeve holder 14 at each retention ridge 50. The deformation also creates a friction force to aid in retaining the sleeve 12 in the sleeve holder 14. As seen in FIGS. 5, 6, and 8, the sleeve holder 14 may further include other mechanical mechanisms to retain the sleeve 12 in the sleeve holder 14. For example, the spring biased button mechanism 54 seen in FIGS. 5, 6, and 10 provides retaining force on the sleeve member 12 that is user friendly, as will be discussed.

Figure 10:
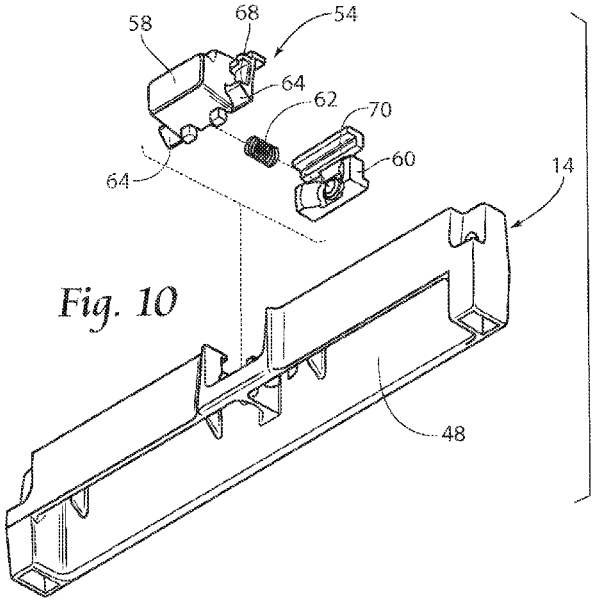
FIG. 10 is an exploded view of the sleeve holder illustrated in FIGS. 5 and 6.
Figure 11:
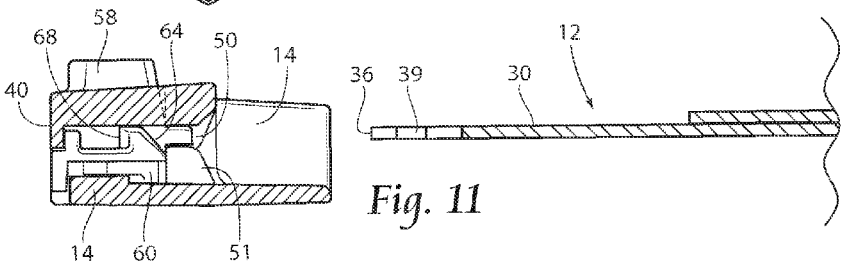
FIGS. 11-13 are fragmentary sectional views illustrating a card retaining sleeve being positioned into the sleeve holder illustrated in FIG. 10.
Figure 12:
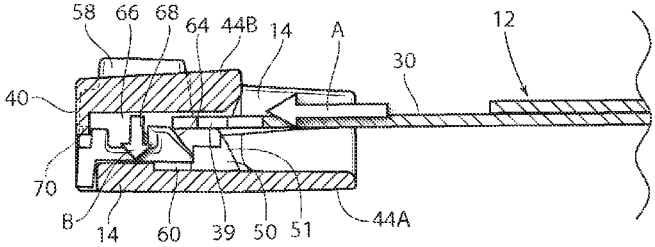
Figure 13:
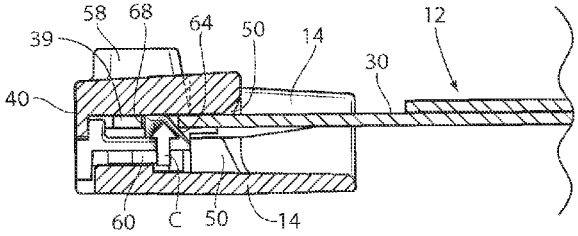
Figure 13A:
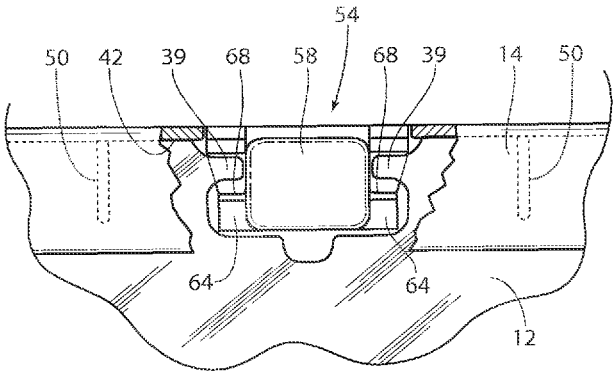
FIG. 13A is a fragmentary top view showing arrangement of the various components when the card retaining sleeve is seated in the sleeve holder.

With specific attention now to FIG. 10, it may be seen that the button mechanism 54 includes a button member 58, a stroke limiter 60, and a compression spring 62. The stroke limiter 60 includes a flange 70 to limit the travel or stroke of the button member 58. Limiting the stroke of the button member 58 is desired since unlimited stroke would allow the button member 58 to move to a fully depressed condition at which point the button mechanism 54 may become disassembled. The button member 58 further includes a ramp portion 64. Action of the button mechanism 54 in retention of the sleeve member 12 is best seen in the views of FIGS. 11-14. The user may easily and quickly install the sleeve 12 in the sleeve holder 14. To engage the sleeve 12 in the sleeve holder 14, the sleeve 12 is first inserted into the slot 48 of sleeve holder 14. As the sleeve is moved in the direction of arrow A, the top profile 30 is directed by the ramped leading edge 51 into the slot 48. The tabs 39 of top profile 30 then come in contact with the ramp portion 64 of button member 58. Continued movement of the sleeve member 12 in the direction of arrow A increases pressure on the ramp portion 64 by the tabs 39 and creates a downward force on the ramp portion 64 in the direction of arrow B. Further movement of the button member 58 and ramp 64 in the direction of arrow B creates a gap 66 between the ramp 64 and the sidewall 44B. The gap 66 permits the top edge 36 and tabs 39 to advance further into the cavity 46 and toward the top 40 of the sleeve holder 14. The tabs 39 move over and beyond the ramp portion 64 where the tabs 39 finally seat against the back surface 68 of a respective ramp portion 64 while the button 58 moves in the direction of arrow C to secure the sleeve member 12 in the sleeve holder 14. The position of the sleeve 12 and sleeve holder 14 illustrated in FIGS. 13 and 13A depicts the sleeve 12 securely positioned in the sleeve holder 14, with the button mechanism 54 locking the sleeve 12 in place, and the tabs 39 resisting pullout in the direction of arrow E due to their engagement against back surface 68. With specific attention to FIG. 13A, the tabs 39 may be viewed positioned against the back surface 68 of the ramps 64.

Figure 14:
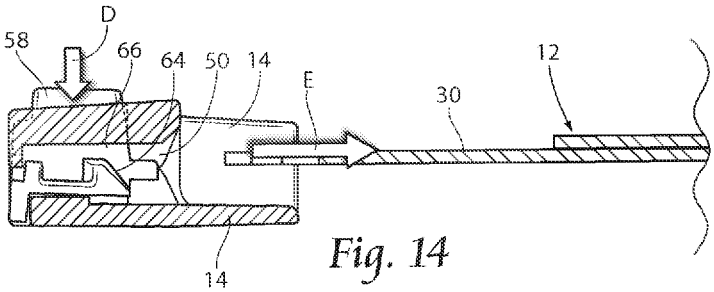
FIG. 14 is a view similar to that of FIGS. 11-13, but showing release and withdrawal of the card retaining sleeve.

Release of the sleeve 12 may be seen in the view of FIG. 14. As shown, the button member 58 is depressed and biased against the action of the compression spring 62 in the direction of arrow D. The ramps 64 are thereby moved downward while also moving the back surface 68 to permit the release of the tabs 39. The action also creates the gap 66 to permit removal of the sleeve 12 from the sleeve holder 14 in the direction of arrow E.

With attention now to FIGS. 15-21, an alternative card holding system 10A may be viewed. Similar to the previous embodiment, the system 10A of these views includes a card retaining sleeve 12A and a sleeve holder 14A. As seen, and similar to the retaining sleeve 12 previously described, the card retaining sleeve 12A of these views includes a sleeve body 18 having a front panel 20, a back panel 22, two opposing side edges 26, and at least one closed edge 24 (see FIG.

Figure 15:
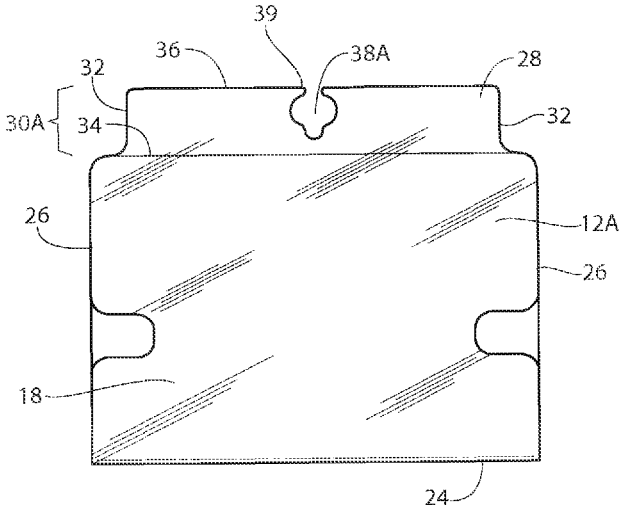
FIG. 15 is a front view of a card retaining sleeve for use in the present system, similar to that of FIG. 4, but showing an alternative margin profile.

15). The retaining sleeve 12A further includes a top portion 28, oppositely disposed from the closed edge 24. As shown, the top portion 28 extends laterally from the sleeve body 18 to form a top marginal edge profile 30A. The profile 30A shown in these views includes two opposed side marginal edge portions 32 extending laterally from the sleeve body 18 and, as seen in FIG. 15, a bottom edge portion 34 attached to the sleeve body 18. A top marginal edge portion 36 intersects with the opposed side marginal edges 32 and further includes an alternative cut out edge portion 38A which extends inwardly relative to the side marginal edges 32. As in the previous embodiment, the sleeve 12A preferably includes a cut out edge portion 38 having tabs 39 for engagement with the sleeve holder 14A, as will be discussed.

Figure 16:
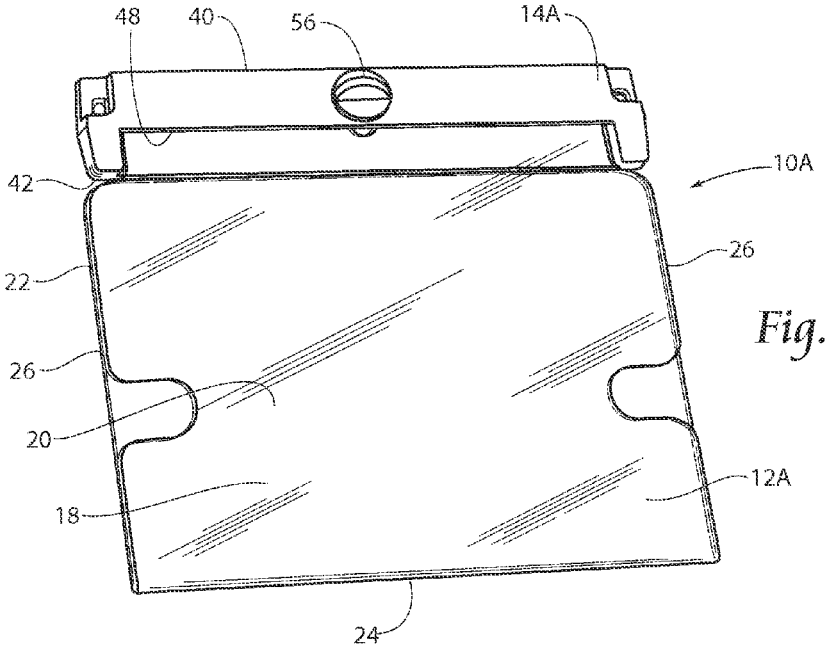
FIG. 16 is a perspective view of a card retaining system with the sleeve holder having an alternative locking mechanism.
Figure 17:
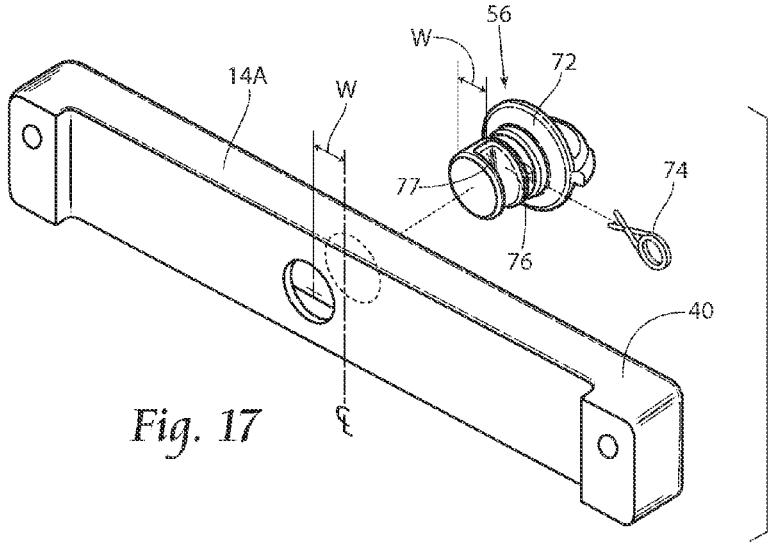
FIG. 17 is an exploded view of the sleeve holder illustrated in FIG. 16.

Similar to the previously discussed sleeve holder 14, the sleeve holder 14A shown in FIGS. 16 and 17 includes a top 40, a bottom 42, and two side walls 44A, 44B forming a cavity 46 therebetween (not seen in this view). Also similar to the previous embodiment, the cavity 46 includes an entrance slot 48 adapted to receive the top portion 28 of the card retaining sleeve 12A and further includes side walls 44A, 44B having retention ridges 50 (not seen in this view). The retention ridges 50 used in the sleeve holder 14A have a general ramped shape and arrangement that is similar to that illustrated in previous views. As further seen in FIG. 16, the sleeve holder 14A may be further provided with alternative mechanical sleeve retention, such as the rotatable, spring biased knob mechanism 56 shown. As with the spring biased button mechanism 54 described previously, the rotatable spring biased knob mechanism 56 provides retaining force on the sleeve member 12A keeps the sleeve 12A secure within the sleeve holder 14A, as will be discussed.

With specific attention now to FIG. 17, it may be seen that the rotatable, spring biased knob mechanism 56 used in conjunction with sleeve holder 14A, includes a knob member 72 and a torsion spring 74. As shown, the knob member 72 includes a grooved portion 76. The grooved portion 76 further includes surface 77. The torsion spring 74 biases the rotatable knob mechanism 56 to first or second positions which correspond to the release or locked positions relative the retaining sleeve 12A. It is to be noted that the rotatable, spring biased knob mechanism 56 is located on the sleeve holder 14A at a position offset from the sleeve holder center line (seen as line CL in this view). The rotatable, spring biased knob mechanism 56 is offset from the centerline of the sleeve holder 14A a distance W approximately equal to one quarter of the rotatable, spring biased knob mechanism 56 rotatable diameter. The offset distance W permits facile installation of the sleeve 12A into the sleeve holder 14A with either the front panel 20 or rear panel 22 in the forward facing position. Further, the grooved portion 76 is approximately one half the overall diameter of the rotatable, spring biased knob mechanism 56 while the surface 77 transverses the approximate center of the rotatable, spring biased knob mechanism 56 diameter. Action of the rotatable, spring biased knob mechanism 56 and its interaction with the sleeve 12A during insertion and release is best seen in the views of FIGS. 18-21.

Figure 18:
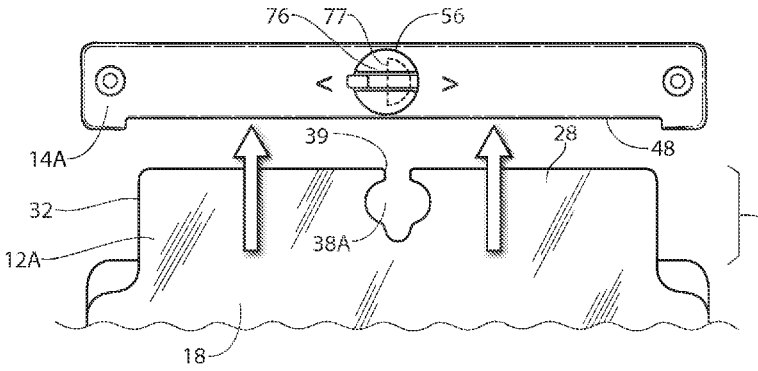
FIGS. 18 and 19 are fragmentary sectional views illustrating a card retaining sleeve being positioned into the sleeve holder illustrated in FIG. 17.
Figure 19:
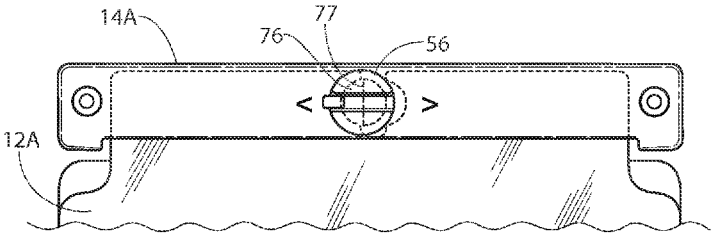
Figure 20:
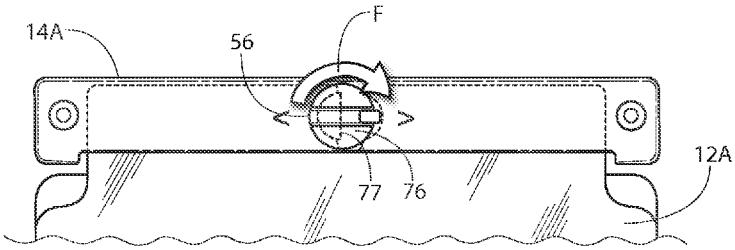
FIGS. 20 and 21 are views similar to that of FIGS. 18 and 19, but showing release and withdrawal of the card retaining sleeve.
Figure 21:
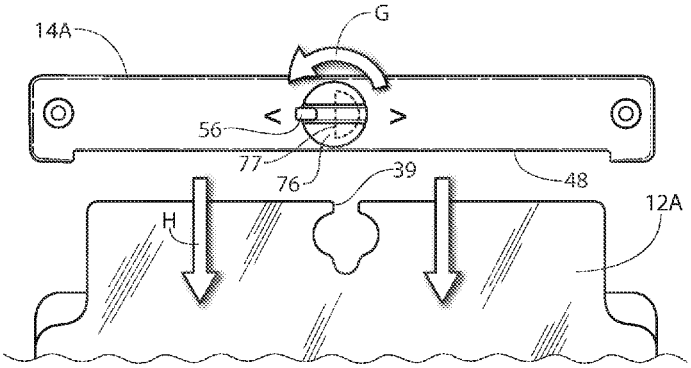
Figure 25:
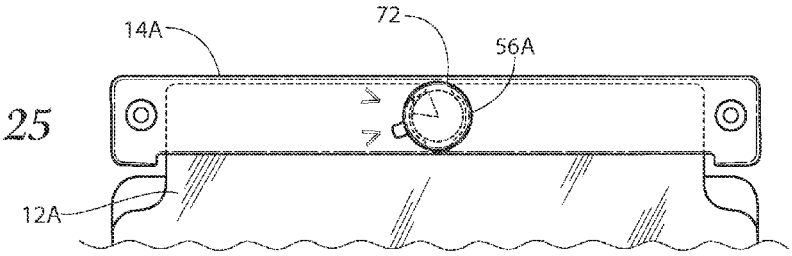
Figure 26:
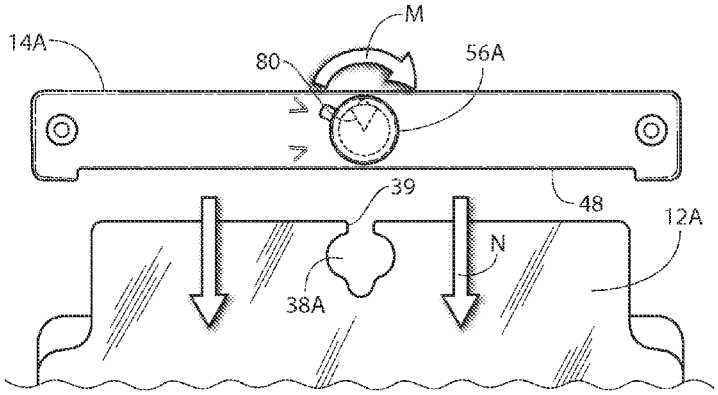
FIG. 26 is a view similar to that of FIGS. 23-25, but showing release and withdrawal of the card retaining sleeve.

To engage the sleeve 12A in the sleeve holder 14A, the sleeve 12A is first inserted into the entrance slot 48 of the sleeve holder 14A. As is shown in FIG. 18, the sleeve 12A is inserted into the entrance slot 48 of sleeve holder 14A while the rotatable, spring biased knob mechanism 56 is in a first, release position. During engagement and insertion, the tab 39 of top profile 30 pass around the groove 76 and groove surface 77 until the sleeve 12A top edge 36 is seated in the holder 14A. Rotation of the knob member 72 in the direction of arrow F (see FIG. 20) moves the groove 76 and groove surface 77 to a second, locked position. Since the rotatable, spring biased knob mechanism 56 is offset from the holder 14A center line CL, this rotation moves the groove 76 and groove surface 77 against the cutout portion 38 to thereby lock the sleeve 12A in the sleeve holder 14A. Release of the sleeve 12A may be seen in the view of FIG. 21. As shown, the knob member 72 is rotated and biased against the action of the torsion spring 74 in the direction of arrow G. The groove 76 and groove surface 77 are thereby moved to be in alignment with the cutout position 38 to permit removal of the sleeve 12A from the sleeve holder 14 in the direction of arrow H.

With attention now to FIGS. 22-26, another card holding system 10A having an alternative rotatable, spring biased knob mechanism 56A may be viewed. Similar to the previous embodiments, the system 10A of these views includes a card retaining sleeve 12A and a sleeve holder 14A. As with the previous embodiments, and as seen in FIG. 15, the card retaining sleeve 12A for use with the alternative rotatable, spring biased knob mechanism 56A, includes a sleeve body 18 having a front panel 20, a back panel 22, two opposing side edges 26, and at least one closed edge 24. As in the previous embodiment, the retaining sleeve 12A includes a top portion 28, oppositely disposed from the closed edge 24. The top portion 28 extends laterally from the sleeve body 18 to form a top marginal edge profile 30A. The profile 30A shown in these views is similar to that shown in FIGS. 15-21 and includes two opposed side marginal edge portions 32 extending laterally from the sleeve body 18 and a bottom edge portion 34 attached to the sleeve body 18. A top marginal edge portion 36 intersects with the opposed side marginal edges 32 and further includes cut out edge portion 38A which extends inwardly relative to the side marginal edges 32. The cut out edge portion 38A resembles that shown in FIGS. 15-21 and includes tabs 39 for engagement with the sleeve holder 14A.

Similar to the previously discussed sleeve holders 14, 14A the sleeve holder 14A shown in FIG. 22 includes a top 40, a bottom 42, and two side walls 44A, 44B forming a cavity 46 therebetween, the cavity 46 includes an entrance slot 48 adapted to receive the top portion 28 of the card retaining sleeve 12 and further includes side walls 44A, 44B having retention ridges 50 (not seen in these views). As is further seen in FIGS. 22 and 22A, the sleeve holder 14A may be provided with an alternative rotatable spring biased knob 56A. Like the rotatable spring biased knob 56 discussed in relation to FIGS. 15-21, the rotatable spring biased knob 56A seen in these views provides retaining force on the sleeve member 12A to keep the sleeve 12A secure within the sleeve holder 14A.

With specific attention now to FIGS. 22 and 22A, it may be seen that the alternative spring biased knob 56A includes a knob member 72 and an extension spring member 78. The knob member 72 further includes a groove 76 having a ramp portion 80. It is to be noted that like the arrangement illustrated in FIGS. 15-21, the rotatable spring biased knob mechanism 56A of these views is located on the sleeve holder 14A at a position offset from the sleeve holder center line (see FIG. 17 for example). The offset distance, while not specifically shown in these views, is understood to be approximately equal to one quarter of the rotatable spring biased knob mechanism 56A rotatable diameter, as shown in FIG. 17. This offset distance permits facile installation of the sleeve 12A into the sleeve holder 14A with either the front panel 20 or rear panel 22 in the forward facing position. Action of the rotatable spring biased knob mechanism 56A is best seen in the views of FIGS. 23-26.

As shown in FIG. 23, to easily and quickly engage the sleeve 12A in the sleeve holder 14A, the sleeve 12A is first inserted into the entrance slot 48 of sleeve holder 14A in the direction of arrow J. FIG. 24 depicts the next step in which the sleeve 12A continues to move into the holder 14A. As illustrated, a tab 39 of top profile 30 contacts a portion of the ramp 80 and urges the knob member 72 to rotate in the direction of arrow K (see FIG. 24) against the bias of the spring member 78 (not seen in this view). While the sleeve 12A is further inserted into the cavity 46, the tab 39 moves up the ramp 80 and beyond it, wherein the bias of the spring member 78 rotationally snaps the knob member 72 into a locked position (see FIG. 25). Release of the sleeve 12A may be seen in the view of FIG. 26. As shown, the knob member 72 is rotated and biased against the action of the spring member 78 in the direction of arrow M. The ramp 80 is thereby moved to permit removal of the sleeve 12A from the sleeve holder in the direction of arrow N.

Figure 27:
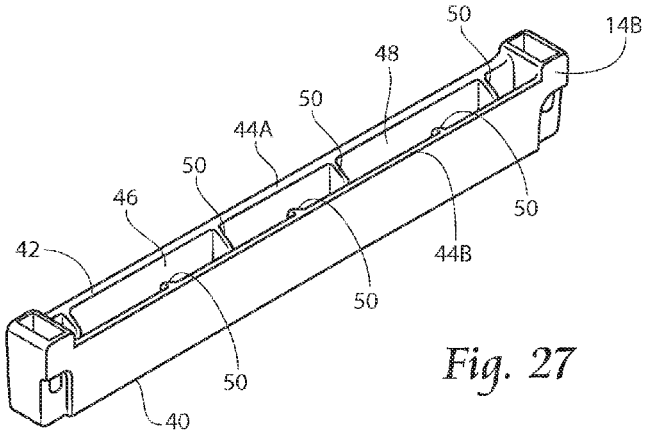
FIG. 27 is a perspective view of an alternative sleeve holder having no mechanical locking mechanism.

FIG. 27 illustrates another embodiment of the sleeve holder 14B. This embodiment, similar to those previously mentioned, includes a top 40, a bottom 42, and two side walls 44A, 44B forming a cavity 46 therebetween. The cavity 46 includes an entrance slot 48 accessible from the bottom 42. The entrance slot 48 is adapted to receive the top portion 28 of a card retaining sleeve 12 (not seen in this view). The cavity 46 includes side walls 44A, 44B having retention ridges 50 which extend laterally inwardly from the side walls 44A, 44B and into the cavity 46. As in the previous embodiments, the ridges 50 on sidewall 44A and the ridges on sidewall 44B do not line up with one another, but rather, are preferably staggered or off set in the cavity 46 interior. The sleeve holder 14B shown in FIG. 27 retains the sleeve 12 by way of the friction between the sleeve 12 and the sleeve holder 14B. The friction is due to the force created from the deformation of the sleeve top portion 28 against the sleeve holder 14B. The embodiment illustrated in FIG. 27 requires no further mechanical sleeve retention, such as the spring biased button 54 or spring biased knob 56; 56A shown in previous embodiments, but rather relies on the deformation and friction between the sleeve 12 and sleeve holder 14B provided by the ridges 50.

Figure 28:
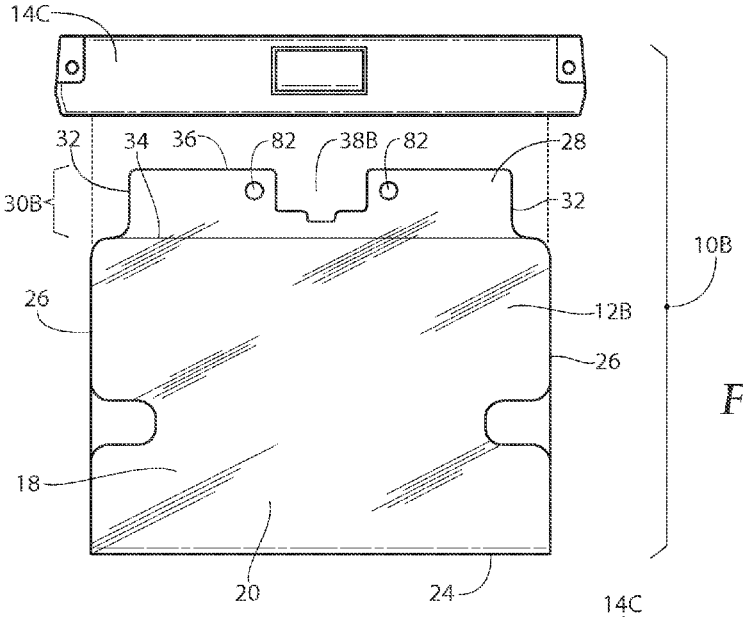
FIG. 28 is a front view of an alternative system with card retaining sleeve and sleeve holder.

Referring now to FIGS. 28-33, another card holding system 10B having an alternative spring biased button mechanism 54A may be viewed. Similar to the previous embodiments, the system 10B of these views includes a card retaining sleeve 12B and a sleeve holder 14C. As with the previous embodiments, and as seen in FIG. 28, the card retaining sleeve 12B for use with the alternative spring biased button mechanism 54A, includes a sleeve body 18 having a front panel 20, a back panel 22, two opposing side edges 26, and at least one closed edge 24. As in the previous embodiments, the retaining sleeve 12B of these views includes a top portion 28, oppositely disposed from the closed edge 24. The top portion 28 extends laterally from the sleeve body 18 to form a top marginal edge profile 30B. The profile 30B shown in these views includes two opposed side marginal edge portions 32 extending laterally from the sleeve body 18 and a bottom edge portion 34 attached to the sleeve body 18. A top marginal edge portion 36 intersects with the opposed side marginal edges 32 and further includes cut out edge portion 38B which extends inwardly relative to the side marginal edges 32. As shown, the top marginal edge profile 30B further includes at least one aperture 82 for engagement with the sleeve holder 14C and spring biased button mechanism 54A, as will be discussed.

Figure 29:
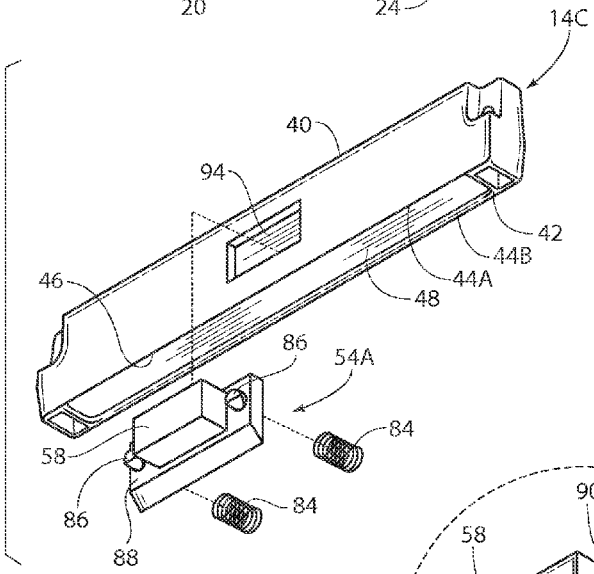
FIG. 29 is an exploded view of the sleeve holder for use in combination with the card retaining sleeve illustrated in FIG. 28, with FIG. 29A showing a detail of the button mechanism.
Figure 29A:
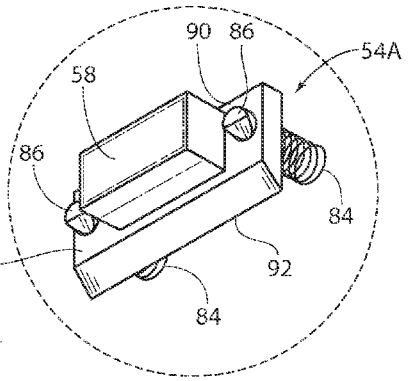

Similar to the previously discussed sleeve holders 14, 14A, 14B the sleeve holder 14C shown in FIG. 29 includes a top 40, a bottom 42, and two side walls 44A, 44B forming a cavity 46 therebetween, the cavity 46 includes an entrance slot 48 adapted to receive the top portion 28 of the card retaining sleeve 12B. Unlike the previous embodiments, the sleeve holder 14C of these views does not include retention ridges 50. Rather, the alternative spring biased button mechanism 54A includes a pair of springs 84 and ramped pins 86. The arrangement of the spring biased button mechanism 54A of these views both secures the card retaining sleeve 12B in the sleeve holder 14C and also minimizes vibration and rattling of the sleeve 12B when the system 10B is used on a mobile support surface, such as a golf cart 11 (see FIG. 3), as will be discussed. As is further viewed in FIGS. 29 and 29A, the button mechanism 54A includes a button member 58 and a ramped support 88 having a front surface 90 and a rear surface 92. As seen, the ramped pins 86 extend laterally from the front surface 90 of the ramped support 88, with the springs 84 mounted on the rear surface 92. The springs 84 normally bias the ramped pins 86, button member 58, and ramped support 88 toward side wall 44A, while the button member 58 is seated in aperture 94 of sleeve holder 14C. Action of the spring biased button mechanism 54A is best seen in the views of FIGS. 30-33.

Figure 30:
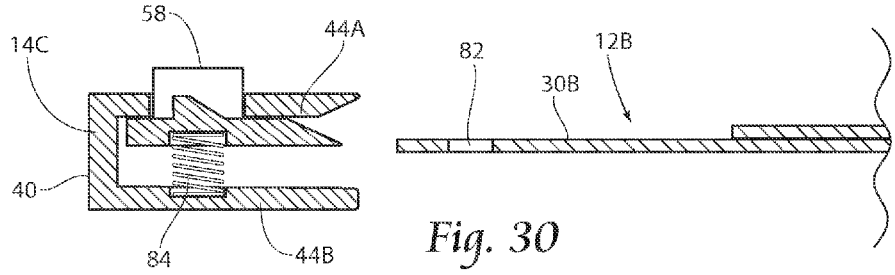
FIGS. 30-33 are fragmentary sectional views illustrating a card retaining sleeve being positioned into the sleeve holder illustrated in FIGS. 29, 29A.
Figure 31:
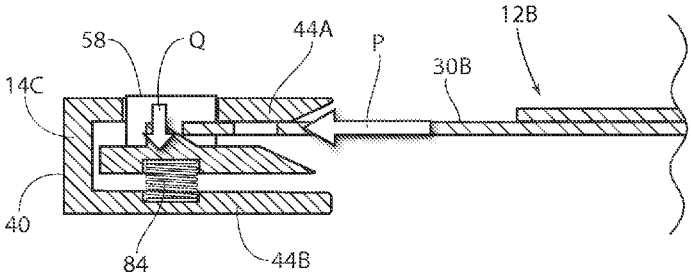
Figure 32:
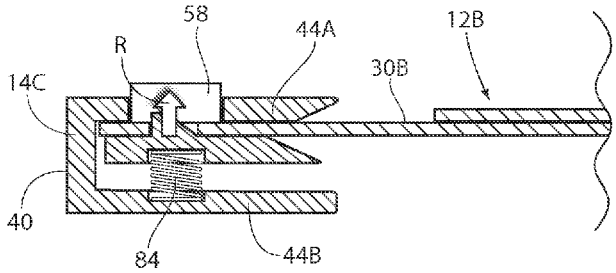
Figure 33:
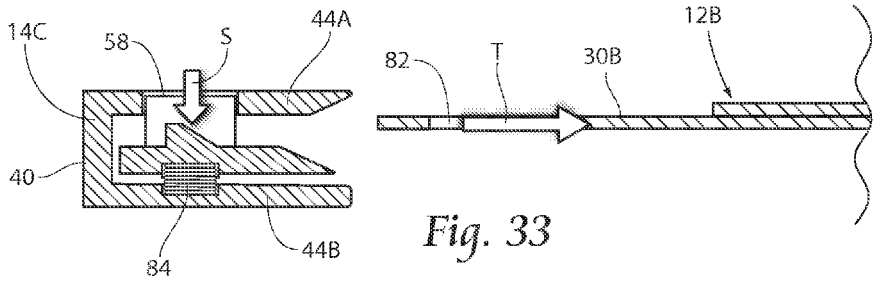

As shown in FIGS. 30 and 31, to easily and quickly engage the sleeve 12B in the sleeve holder 14C, the sleeve 12B is first inserted into the entrance slot 48 of the sleeve holder 14C in the direction of arrow P while the button member 58 is depressed in the direction of arrow Q. FIG. 32 depicts the next step in which the sleeve 12B continues to move into the holder 14C. As illustrated, the top edge 36 of the top profile 30B moves over the ramped support 88 and over the ramped pins 86. Once the top edge 36 passes the ramped pins 86, the button member 58 moves in the direction of arrow R thereby pushing the ramped pins 86 through the apertures 82. The sleeve 12B is now secured in the sleeve holder 14C. Release of the sleeve 12B from the sleeve holder 14C may be viewed in FIG. 33. To release the sleeve 12B, the button member is depressed in the direction of arrow S and against the bias of the spring members 84. The ramped pins 86 are thereby moved out of the apertures 82 to permit removal of the sleeve 12B from the sleeve holder in the direction of arrow T.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

We claim:

1. A card holder assembly of comprising:

a card retaining sleeve having a front panel, a back panel, at least one closed edge, and at least one open edge, wherein said card retaining sleeve includes a top edge having a laterally extending portion, the extending portion including opposed side margin edges and a cutout portion; and a sleeve holder having a first side wall and a second side wall, said side walls forming a cavity therebetween, the cavity including an open slot, and wherein the first side wall includes at least one laterally extending gripping member.

2. The assembly of claim 1 wherein the second side wall includes at least one laterally extending gripping member.

3. The assembly of claim 2 wherein the gripping members comprise retention ridges extending laterally inwardly from the side walls and into the cavity.

4. The assembly of claim 3 wherein the ridges on the first side wall and the ridges on the second side wall are offset from one another.

5. The assembly of claim 1 wherein said cut out edge portion extends inwardly relative to the side marginal edges and including at least one tab member.

6. The assembly of claim 1 wherein said sleeve holder further includes a mechanical sleeve retainer.

7. The assembly of claim 6 wherein said mechanical sleeve retainer comprises a spring biased button mechanism.

8. The assembly of claim 7 wherein said button mechanism includes a stroke limiter, a compression spring, and a button member, said button member having at least one ramp portion.

9. The assembly of claim 6 wherein said mechanical sleeve retainer comprises a rotatable spring biased knob mechanism.

10. The assembly of claim 9 wherein said rotatable spring biased knob mechanism includes a knob member having a grooved portion.

11. The assembly of claim 10 wherein said grooved portion includes a ramp.

* * * * *